US012065908B2

(12) United States Patent
Nickerson

(10) Patent No.: US 12,065,908 B2
(45) Date of Patent: Aug. 20, 2024

(54) ADVANCED EXTENDED FLOWBACK SYSTEM

(71) Applicant: Marine Well Containment Company LLC, Houston, TX (US)

(72) Inventor: David Nickerson, Houston, TX (US)

(73) Assignee: Marine Well Containment Company, Houston, TX (US)

( * ) Notice: Subject to any disclaimer, the term of this patent is extended or adjusted under 35 U.S.C. 154(b) by 33 days.

(21) Appl. No.: 17/654,747

(22) Filed: Mar. 14, 2022

(65) Prior Publication Data

US 2023/0287764 A1 Sep. 14, 2023

(51) Int. Cl.

| | |
|---|---|
| ***E21B 41/00*** | (2006.01) |
| ***E21B 33/035*** | (2006.01) |
| ***E21B 33/038*** | (2006.01) |
| ***E21B 43/01*** | (2006.01) |
| ***E21B 43/36*** | (2006.01) |

(52) U.S. Cl.

CPC ..... *E21B 41/0021* (2013.01); *E21B 33/0355* (2013.01); *E21B 33/038* (2013.01); *E21B 41/0007* (2013.01); *E21B 43/0122* (2013.01); *E21B 43/36* (2013.01)

(58) Field of Classification Search

CPC ... E21B 41/0021; E21B 43/0122; E21B 43/36
See application file for complete search history.

(56) References Cited

U.S. PATENT DOCUMENTS

| | | | | |
|---|---|---|---|---|
| 3,590,919 | A * | 7/1971 | Talley, Jr. | B01D 19/00 166/357 |
| 4,416,565 | A | 11/1983 | Ostlund | |
| 6,651,745 | B1 * | 11/2003 | Lush | E21B 43/36 166/267 |
| 8,322,437 | B2 * | 12/2012 | Brey | E21B 33/035 166/344 |
| 2005/0006086 | A1 | 1/2005 | Gramme | |
| 2012/0121335 | A1 * | 5/2012 | Fedotov | E21B 43/34 405/64 |
| 2012/0155964 | A1 * | 6/2012 | Carter | E21B 43/0122 405/60 |

(Continued)

FOREIGN PATENT DOCUMENTS

| | | | | |
|---|---|---|---|---|
| GB | 2071020 | A | 9/1981 | |
| WO | WO-2008129292 | A2 * | 10/2008 | B63B 22/026 |

OTHER PUBLICATIONS

Andreussi, H.P., and G. De Ghetto. "CUBE—A New Technology for the Containment of Subsea Blowouts." J Pet Technol 65 (2013): 32-35. doi: https://doi.org/10.2118/0113-0032-JPT.

(Continued)

*Primary Examiner* — Matthew R Buck

(74) *Attorney, Agent, or Firm* — Osha Bergman Watanabe & Burton LLP

(57) ABSTRACT

A system for emergency response to a well control incident is disclosed, which includes a capture device fitted to a subsea wellhead, a pipeline termination unit fluidly connected to the capture device, and a subsea module fluidly connected to the pipeline termination unit via a subsea flowline, wherein the subsea module comprises a subsea separator, and wherein the subsea module is anchored to a seabed. The system also includes a mini spar fluidly connected to the subsea module by a riser system.

20 Claims, 3 Drawing Sheets

(56) References Cited

U.S. PATENT DOCUMENTS

| | | | | |
|---|---|---|---|---|
| 2012/0211234 | A1* | 8/2012 | Wilie | E21B 43/36 166/345 |
| 2013/0043035 | A1 | 2/2013 | Hale | |
| 2013/0046126 | A1* | 2/2013 | Varney | E21B 43/0122 588/249 |
| 2013/0140035 | A1 | 6/2013 | Smith et al. | |
| 2013/0206421 | A1 | 8/2013 | De Ghetto et al. | |
| 2013/0270194 | A1* | 10/2013 | Allen | E02F 7/065 96/155 |
| 2014/0356068 | A1 | 12/2014 | Andritsos et al. | |
| 2015/0034570 | A1 | 2/2015 | Andreussi | |
| 2015/0204156 | A1 | 7/2015 | Crossley et al. | |
| 2015/0240604 | A1* | 8/2015 | Vu | E21B 43/0122 405/64 |
| 2016/0160614 | A1* | 6/2016 | Ward | E21B 43/0122 210/170.11 |
| 2016/0341024 | A1 | 11/2016 | Unnam et al. | |
| 2017/0234098 | A1 | 8/2017 | Bjørkhaug | |

OTHER PUBLICATIONS

Song, S., and Kouba, G. (May 18, 2000). "Fluids Transport Optimization Using Seabed Separation." ASME. J. Energy Resour. Technol. Sep. 2000; 122(3): 105-109. https://doi.org/10.1115/1.1289384.

Kim, Y, Woo, N, Kim, H, Han, S, Ha, J, & Huh, S. "Study on the Numerical Analysis of In-Line Type Subsea Separator for Liquid-Liquid Mixture Flow." Proceedings of the ASME 2018 International Mechanical Engineering Congress and Exposition. vol. 7: Fluids Engineering. Pittsburgh, Pennsylvania, USA. Nov. 9-15, 2018. V007T09A040. ASME. https://doi.org/10.1115/IMECE2018-87301.

Finn, L. (Nov. 1, 1999). "Reliable Riser Systems for Spars." ASME. J. Offshore Mech. Arct. Eng. Nov. 1999; 121(4): 201-206. https://doi.org/10.1115/1.2829568.

International Search Report issued in Application No. PCT/US23/15200, mailed on Jun. 23, 2023 (3 pages).

Written Opinion issued in Application No. PCT/US23/15200, mailed on Jun. 23, 2023 (23 pages).

* cited by examiner

ADVANCED EXTENDED FLOWBACK SYSTEM

BACKGROUND

In the event of a subsea well control incident (e.g., a well blowout), there are a number of systems which may be employed in response. One of the primary goals in a well control incident is shutting off flow of fluids from a compromised well. Well fluids may comprise a combination of oil, water, natural gas, solids such as sand, and other particulates. One way in which this may be achieved is the use of a primary containment device such as a capping stack, which is a series of valves that can be installed on top of a compromised well in order to shut off the flow of fluid.

In situations where a well is unable to be immediately shut off with a capping stack, various containment systems may be employed to capture hydrocarbons leaking from the well while additional abandonment activities such as relief well drilling are being conducted. An interim collection system may be employed in an open flow configuration to capture some of the well fluids during this period. Alternatively, an extended flowback system may be employed in a closed flow configuration to capture all of the well fluids during this period.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for emergency response to a well control incident. The system may include a capture device fitted to a subsea wellhead, a pipeline termination unit fluidly connected to the capture device, and a subsea module fluidly connected to the pipeline termination unit via a subsea flowline. The subsea module may include a subsea separator, and the subsea module may be anchored to a seabed. The system may further comprise a mini spar fluidly connected to the subsea module by a riser system.

In another aspect, embodiments disclosed herein relate to a method for responding to a subsea well control incident. The method may include installing a capture device on a wellhead or associated component of a well and diverting well fluids from the wellhead to a subsea module via a pipeline connector system. The method may further include separating the well fluids into at least two phases comprising a liquid phase and a gas phase and transporting the at least two phases to a mini spar through a riser system. The method may also include transporting the liquid phase from the mini spar to a storage vessel and flaring the gas phase using at least one flare mounted on the mini spar.

Other aspects and advantages of the claimed subject matter will be apparent from the following description and the appended claims.

Figure 1:
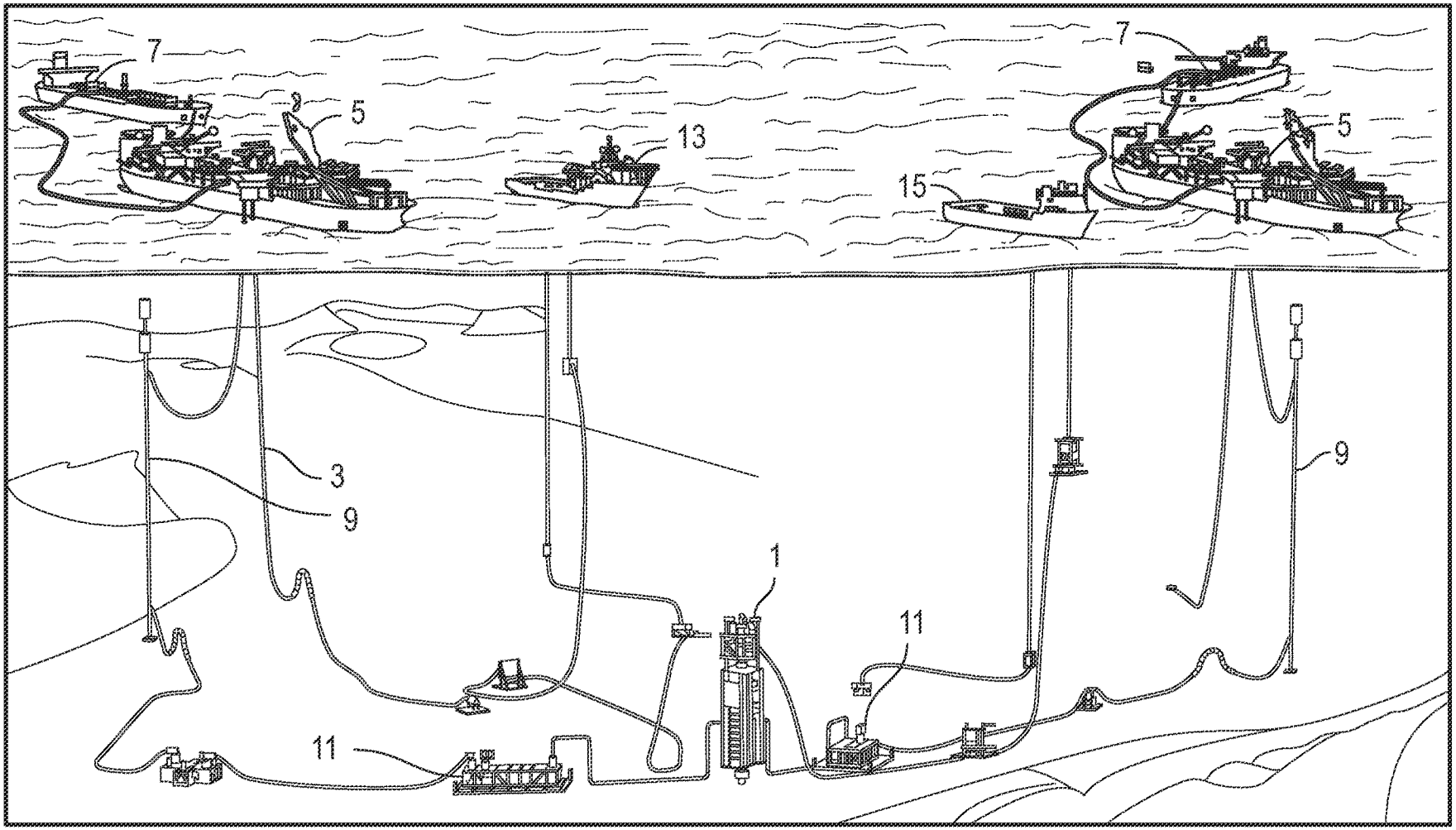
FIG. 1 (Prior Art)
FIG. 1 shows a conventionally used extended flowback system.

Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Methods and systems disclosed herein relate generally to capturing fluids (e.g., oil, gas, and water) from a subsea well during a well control incident (e.g., a blowout of the well or damaged well component) to minimize impact on the environment.

There are some situations in which a damaged subsea well is not able to be immediately capped. In such scenarios, a containment system having fluid capturing equipment may be positioned over the wellhead to capture fluids escaping from the damaged well. Depending on the various parameters of the damaged well (e.g., amount and rate of fluid escaping the well, type of damage to the wellhead, etc.), different types of capture devices may be selected, such as capping stacks, top hats, containment domes, riser insertion tube tools (RITTs), and others. Examples of containment systems are described in more detail below, but generally, containment systems will include a capture device positioned above the well in an orientation to have escaping fluid enter and one or more outlets for directing the captured fluid to a subsequent processing system.

Fluid captured by a containment system may be routed through subsequent subsea systems according to embodiments of the present disclosure, which may at least partially process (e.g., cool, heat, or separate) the fluid as it is routed to the surface of the ocean. For example, a subsea separator may be incorporated into a containment system to separate types of fluids and/or sand from the captured fluid at a subsea location. Separated fluids may then be directed to the surface of the ocean. At the surface of the ocean, separated liquids may be collected in one or more storage vessels, and separated gas may be separately burnt off, which may also be referred to as "flaring" natural gas. According to embodiments of the present disclosure, some or all functionalities of the subsea and surface systems may be controlled remotely. Subsea systems and well-control response methods according to embodiments of the present disclosure are described in more detail below and with reference to the drawings.

In the following description of FIGS. 1-3, any component described regarding a figure, in various embodiments disclosed herein, may be equivalent to one or more like-named components described with regard to any other figure. For brevity, descriptions of like-named components may not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

FIG. 1 shows equipment which may typically be used in emergency response operations. In particular, FIG. 1 shows an example of a closed loop system used to contain well fluids, implemented using extended flowback equipment. A capping stack 1 may be installed over a damaged well (e.g., a capping stack with a pressure rating of 20,000 psi). A capping stack 1 is a type of capture device that may be connected to the top of a blowout preventer (BOP) of a wellhead. The capping stack 1 may be connected to a flexible flowline system 3, which routes well fluids up to a Modular Capture Vessel (MCV) 5 at the surface. MCVs 5 are standard oil tanker vessels customized to process and capture well fluids in a well control incident. MCVs 5 may separate liquids and flare associated natural gas. Liquids comprising oil, water, and entrained sand may be stored in the MCVs 5 and can be offloaded to a shuttle tanker 7 once capacity has been reached.

Deepwater drilling (e.g., offshore drilling in the Gulf of Mexico) may occur at water depths between 500 feet and 10,000 feet or more. As a result, there are multiple embodiments of extended flowback systems, each of which is specifically adapted to a given depth range. In one or more embodiments, where drilling occurs at depths between 500 feet and 2,000 feet, a lazy riser system may be utilized, which transports well fluids from the well to the MCV 5 via an attachment to flexible pipes. A lazy riser system may utilize buoyancy to support the system. In other embodiments, where drilling occurs at depths greater than 2,000 feet, a free-standing riser 9 may serve as the conduit connecting the capping stack 1 and the MCV 5. In some well control incidents, it may be beneficial to utilize a system with more than one MCV 5, depending on the amount of well fluids being captured. In such situations, the MCVs 5 may have the combined capacity to capture up to 100,000 barrels of oil and to burn off up to 200 million standard cubic feet of gas per day. In some situations, subsea cooling modules 11 may be fluidly connected between the installed capping stack 1 and the risers 9 to cool captured well fluid as it flows to the risers 9.

In one or more embodiments, a separate dispersant vessel 13 may be incorporated into the extended flowback system. Dispersant may refer to a chemical which breaks up escaping hydrocarbons which have leaked from a damaged well. Dispersant injected at a wellhead may break up oil at the point of release, reducing the accumulation of hydrocarbons at the surface of the water. The dispersant vessel 13 may inject dispersants at the wellhead through a system of flexible hoses or other conduits. In one or more embodiments, a hydrate inhibition vessel 15 may also be incorporated into the extended flowback system. Low sea temperatures can create problems in subsea piping due to the formation of gas hydrates. Hydrate inhibition vessels 15 may inject hydrate inhibitors into the flowback system to prevent the formation of gas hydrates.

Emergency response systems that rely upon conventional surface separation and processing systems such as MCVs 5 are complex and can be challenging to install and operate. As a result, there is a need for a system which is easier and faster to deploy, is simpler and safer to operate, and is more flexible in the types of capture devices that can be used in comparison to current systems. Disclosed herein are embodiments of an emergency response system for subsea well control incidents (e.g., blowouts) which may operate in the absence of MCVs or other surface (vessel based) processing systems. Specifically, disclosed herein are embodiments of an advanced extended flowback system configured to process captured well fluids at the sea floor.

Figure 2:
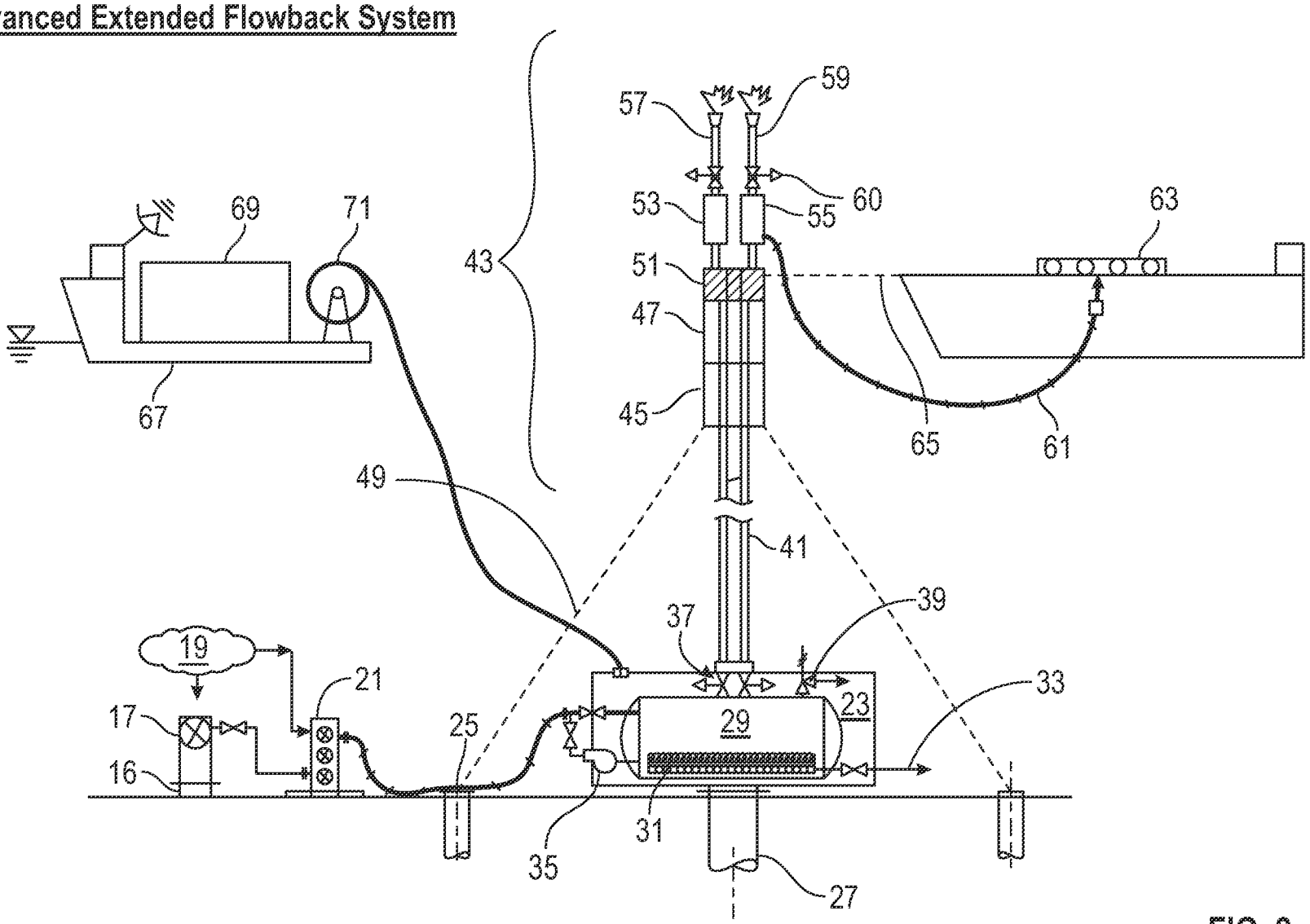
FIG. 2 shows a schematic of an advanced extended flowback system in accordance with one or more embodiments.

Turning now to FIG. 2, FIG. 2 shows an advanced extended flowback system in accordance with one or more embodiments. The entire advanced extended flowback system may be high pressure high temperature rated to safely accommodate fluids from the deepest of offshore wells. A capture device may be fitted to a wellhead 16 during a blowout event or other well-control incident. The capture device may be part of a containment system fluidly connected between a well and a subsea processing system. FIG. 2 shows alternative types of capture devices that may be used to capture well fluids escaping from a well. In one or more embodiments, the capture device may be a capping stack 17. In such embodiments, a closed flow system is formed through which fluids may be transported to the surface. In other embodiments, the capture device may be a top hat or a riser insertion tube tool (RITT) 19, which may be positioned above the wellhead 16 or other point of hydrocarbon release and which may be fluidly connected to subsequent subsea systems. In embodiments using a top hat or RITT 19 to capture escaping well fluids, an open flow system is formed through which fluids may be transported to the surface. The capture devices may be fluidly connected to a pipeline termination unit 21, which may refer to subsea component that is designed to collect fluids from one or more capture devices that capture fluids from the leaking well, either at the same or at different points in time, and which combines captured fluids for discharge into a subsea flowline 25. A pipeline termination unit may include, for example, a pipeline end termination unit (PLET) or a manifold unit. In some embodiments, the pipeline termination unit may include a multi-phase subsea suction booster pump to assist in moving captured fluids.

The pipeline termination unit 21 may be fluidly connected to a subsea module 23 by a subsea flowline 25, which may be a flexible flowline made of alternating metallic and non-metallic tubular layers, a composite flexible flowline (made of alternating carbon and other non-metallic tubular layers, or a rigid steel flowline. The subsea flowline 25 may allow for an offset between the containment system at the wellhead 16 (or other point of hydrocarbon capture) and the subsea module 23 to allow for safe operation of the advanced extended flowback system, allowing vessel traffic associated with the ongoing well remediation efforts to be a sufficient distance away from vessel traffic associated with the advanced extended flowback systems according to embodiments herein. In one or more embodiments, the subsea flowline 25 may be 1 mile in length, though there may be embodiments where the subsea flowline 25 may be shorter or longer.

The subsea module 23 may be anchored to the sea floor by a suction pile system 27. The suction pile system 27 may comprise one or more suction piles, the number of which may depend upon the size of the subsea module 23, tension required in the production riser 41, and the seabed conditions at the desired subsea module 23 location, among other factors. Suction piles are used extensively in subsea drilling and production operations and may act as a foundation to equipment positioned at the sea floor. Suction piles utilize a vacuum to pull and hold the suction pile into the seabed. In some embodiments, a subsea module may be disposed on a mud mat at the sea floor. A mud mat may include a plank or platform that may be used as a support or landing for subsea equipment and may be made of, for example, a polymer or composite (e.g., polyurethane). In some embodiments, a combination of one or more suction piles and a mud mat may be used as a foundation for a subsea module, where the mud mat may be positioned on the suction pile(s) and the subsea module may be positioned on the mud mat.

A subsea module 23 may include fluid processing equipment that may be arranged in a module (e.g., in a framed structure). Providing fluid processing equipment in a module may allow for easier transport and equipment hookup to a subsea well control system, which may be particularly useful for quick response to the well control incident (e.g., a well blowout). Additionally, the framed module structure 23 may be designed to transfer buoyancy loads created by the floating equipment installed above (e.g. mini-spar 43 and production riser 41 (described below)) to suction pile 27 serving as its foundation. As shown in FIG. 2, a subsea module 23 may include a subsea separator 29. In one or more embodiments, the subsea separator 29 may allow for the separation of well fluids into a liquid phase and a gas phase. In other embodiments, the subsea separator 29 may allow for the separation of well fluids into three phases: an oil phase, a gas phase, and a water phase.

In some embodiments, the subsea separator 29 may separate sand or other particulates from a liquid and/or gas phase of the well fluids. In other embodiments, a separate de-sanding unit (not pictured) may be installed in the subsea module 23 between the subsea flowline 25 and the subsea separator 29. A sand flush system 33 may employ a combination of pumps and jetting manifolds installed at the bottom of the de-sander and/or subsea separator 29 to wash sand or other particulates out of the bottom of these vessels. Separated sand or other particulates may then be discharged at the sea floor or pumped to a surface collection vessel. In some embodiments, separated sand may be directed away from the advanced extended flowback system and discharged through piping. For example, a pump may be used to move separated sand through the piping and away from the separator. By discharging separated sand away from the separator, sand buildup around the containment system may be mitigated.

An electric heater 31 may also be included in the subsea separator 29. In other embodiments, the electric heater 31 may be located between the subsea flowline 25 and the subsea separator 29. A subsea heater 31 may be used in processing well fluids to 'deaden' oil prior to transportation to the surface. "Dead oil" refers to oil that has lost its dissolved gases and volatile components. The electric heater 31 may assist in the separation of oil and gas by heating the well fluid, such that the gas phase and light ends in the well fluid (e.g., methane, ethane, propane, butane, and hydrogen) may better separate from the heavier ends in the hydrocarbons, leaving 'dead oil' in the remaining liquid. Oil may need to be "deadened" prior to being transported to the surface due to vapor pressure restrictions of the storage vessel.

In one or more embodiments, a subsea cooling system (not pictured) may also be incorporated into the advanced extended flowback system to assist in the temperature control of captured well fluids. In some embodiments, a subsea cooling system may be included in the subsea separator 29. In other embodiments, the subsea cooler may be located between the subsea flowline 25 and the subsea separator 29. A subsea cooling system may include an arrangement of conduits that move cold water pumped from the surrounding subsea environment around the subsea equipment containing captured well fluids.

In embodiments where the capture devices include a top hat or RITT 19, a multi-phase subsea suction booster pump 35 may also be installed within the subsea module 23. Open loop systems are generally lower in pressure, so a multi-phase subsea suction booster pump 35 may assist in raising pressure in order to transport captured well fluids to the surface. In other embodiments, a multi-phase subsea suction booster pump 35 may additionally be located on the pipeline termination unit 21. The subsea module 23 may further include a plurality of control valves 37, which may include a pressure safety valve (PSV) 39, to relieve pressure in situations where system pressure exceeds a predetermined level, as well as other manual and automatic valves (not pictured) to control the effective separation of well fluids at the sea floor and subsequent transport to the surface.

In some embodiments, more than one subsea module may be used in an advanced extended flowback system. For example, in some embodiments, multiple subsea modules may be fluidly connected together (in series). In some embodiments, multiple subsea modules may be fluidly connected in parallel to a containment system. By using multiple subsea modules in an advanced extended flowback system, larger processing volume may be outputted and/or system redundancy may allow continued processing in case of an upset in one of the subsea module circuits.

The subsea module 23 may be connected to a riser system, which may comprise a pipe-in-pipe riser 41. A pipe-in-pipe riser 41 may include an inner pipe disposed concentrically within an outer tubing, which may be used to flow separated phases of the captured well fluid from the subsea separator 29 to the surface. In one or more embodiments, a liquid phase may flow through the inner pipe and a gas phase may flow through the annular region formed between the inner pipe and the outer pipe. In other embodiments, the liquid phase may flow through the annular region and the gas phase may flow through the inner pipe. Further embodiments may utilize multiple single riser pipes (not pictured), each transporting a different fluid to the surface, or both single and pipe-in-pipe risers used in combination. Riser 41 may be constructed of steel alloy or carbon composite-based materials. A single-phase subsea booster pump (not pictured) may also be installed at the base of the riser 41 where it connects to the subsea separator 29 to aid in the transport of liquids up the riser to the mini-spar 43 at the ocean surface.

The pipe-in-pipe riser 41 may fluidly connect the subsea module 23 with a mini spar 43. A mini spar 43 may include a floating structure supported by buoyancy cans and may hold equipment used for the final processing, transfer of liquids, and flaring of gases at the sea surface. For example, as shown in FIG. 2, the mini spar 43 may include a can, which has a lower section 45 and an upper section 47, and which may support well processing equipment at the surface of the sea. The mini spar 43 may be connected to one or more suction piles 27 via mooring line(s) 49 to anchor the mini spar 43 to the sea floor. The design of the mini-spar mooring system 27, 49 may be sufficient to accommodate the loads of the mini-spar itself, plus an assortment of potential liquid storage and offloading vessels utilized in various configurations that may be tied-off to the mini spar 43 for position keeping.

Additionally, the mini spar 43 may be designed to incorporate any type of conventionally available spar equipment and top tensioning technologies without departing from the scope of this disclosure. For example, a mini spar may include a hull design in accordance with traditional, truss, or cell spar hull designs.

According to embodiments of the present disclosure, a mini spar 43 may be compactly designed with minimal equipment and unmanned operation, unlike conventional spar systems, which are traditionally larger, permanently manned installations with extensive drilling and production equipment installed on top.

In some embodiments, a mini spar 43 may include a floating spar assembly holding equipment limited to transitioning and directing liquids from the subsea systems to storage vessels, providing anchor points for storage vessels to tie-off to, and flaring the hydrocarbon gases captured from the well. Examples of equipment in a mini spar 43 according to embodiments of the present disclosure are described below with reference to FIG. 2.

For example, a mini spar 43 may include a swivel 51 mechanically connected to the upper can section 47 of the mini spar 43. The swivel 51 may allow rotational connection between one or more vessels (e.g., vessel 63) and the mini spar 43. For example, as vessels are situated around the area to collect captured well fluids, movement in the sea and atmosphere environments (e.g., currents and wind) may tend to move the vessels. By connecting a vessel to a swivel 51 on the mini spar 43, the swivel 51 may turn around its rotational axis in conjunction with the connected vessel as the connected vessel moves around the mini spar 43. The swivel 51 may have a first circumferential channel fluidly connected to the inner pipe of the pipe-in-pipe riser 41. The swivel 51 may also have a second circumferential channel fluidly connected to the outer pipe of the pipe-in-pipe riser 41.

In one or more embodiments, the mini spar 43 may also include well fluid processing equipment that may be used to perform final separation and/or processing of captured well fluids at the surface of the sea. For example, the mini spar 43 may include a high efficiency liquid knockout drum 53 and a high efficiency degasser 55. A liquid knockout drum 53 may assist in removing any remaining entrained or condensed liquids from the gas section of the riser that may be created as the gas cools down on its way up the riser 41 to the surface. A knockout drum 53 may include a vessel with an inlet diffuser, de-entrainment mesh pad, or other liquid trapping device that may trap liquid as it flows through the vessel, where the trapped liquid may be collected and directed out of the vessel. Similarly, a degasser 55 may assist in removing any remaining gases from the liquid section of the riser 41 that may be created as the liquid loses pressure on its way up the riser 41 to the surface, ensuring a fully deadened liquid phase before being transferred to the storage vessel. A degasser 55 may include a device that removes gases from liquids by expanding the size of the gas bubbles entrained in the liquid (e.g., using a vacuum) and/or by increasing the surface area available to the liquid to allow gas bubbles to escape (e.g., through cascading baffle plates).

In one or more embodiments, the liquid knockout drum 53 may be fluidly connected to the second circumferential channel of the swivel 51, and the degasser 55 may be fluidly connected to the first circumferential channel of the swivel 51. In other embodiments, the liquid knockout drum 53 may be fluidly connected to the first circumferential channel of the swivel 51 and the degasser 55 may be fluidly connected to the second circumferential channel of the swivel 51.

A mini spar 43 may also include a flare system including one or more flares extending above the surface of the sea, which may be used to flare gas from the captured well fluid. For example, a flare system on a mini spar 43 may include a high-pressure flare 57 for flaring gas separated in the subsea separator 29 (after remaining liquids are first removed in the high efficiency knock-out drum 53), a and a low-pressure flare 59 for flaring residual gas removed in the high efficiency degasser 55. A secondary pressure control system 60 (e.g., pressure control valves) may be disposed between the liquid knockout drum 53 and the high-pressure flare 57 and between the degasser 55 and the low-pressure flare 59 to provide additional controllability of the processing system. In other embodiments (not pictured), liquid burning flares may also be incorporated as an alternative to transferring and storing liquids captured in an adjacent storage vessel, especially in the case of lower hydrocarbon capture rates.

In contrast to conventional spar and offshore production systems, emergency response systems according to embodiments of the present disclosure may be designed to have flaring capabilities sufficient to flare all gas from the captured well fluids. For example, under typical offshore production operations, gas collected from subsea well fluids may be produced, processed, transported, and sold. However, in an emergency response operation, the transportation and sale of natural gas captured from the well is not practical. Thus, in some embodiments, gas that may have otherwise been collected in a non-emergency situation may instead be flared in an emergency response system according to embodiments of the present disclosure.

Well fluid processing equipment held on the mini spar 43, including, e.g., knockout drums, degassers, and flares, may be mounted directly or indirectly to the swivel 51, such that rotation of the swivel 51 may also rotate the well fluid processing equipment.

A floating hose 61 may fluidly connect the liquid outlet from the swivel 51 and a conventional oil tanker vessel 63, allowing for the storage of liquids from captured well fluids from the mini spar 43 to the oil tanker vessel 63. In other embodiments (not pictured), multiple tankers and/or offshore barges may be employed for oil storage and offloading utilizing a variety of bow or side loading systems. Once an oil tanker vessel 63 reaches capacity, it may simply be swapped out with another oil tanker vessel 63 without any need for offshore offloading operations. The oil tanker vessel 63 may further be tethered to the mini-spar 43 via a backdown line 65, which may be commonly referred to in maritime industry as a hawser, connected to an anchor point located on the swivel 51. In one or more embodiments, the backdown line 65 may be around 1,000 feet, or other appropriate distances taking into consideration the radiant heat expected from the flare, unless a water curtain is provided. The backdown line 65 may allow for radial movement of the oil tanker vessel 63 around the stationary mini spar 43.

The advanced extended flowback system shown in FIG. 2 may be controlled from the surface by one or more, such as three or more, offshore supply vessels (OSVs) 67, each equipped with standardized monitoring, control, power, and chemical injection modules 69 (e.g., including a tank of chemicals). The chemical injection facet may incorporate the ability to inject multiple different chemicals separately or concurrently to optimize containment system performance including but not limited to subsea dispersants, hydrate inhibitors, paraffin inhibitors, or de-emulsifiers. Each self-contained module 69 is outfitted with the equipment necessary to provide electronic monitoring and control, electrical power, and chemical injection at a variety of different points along the containment system depending on configuration and specific requirements of the incident response, including but not limited to (1) the capture device, e.g., capping stack 17, top hats or RITTs 19, (2) the pipeline termination unit 21, (3) the subsea module and associated equipment 23, (4) the production riser 41, and (5) the mini-spar 43.

Monitoring may include monitoring pressures, temperatures, and flow rates within a system apparatus and/or in the environment around the system in order to inform control decisions. One skilled in the art will be aware that there are many more parameters that may also be monitored throughout operation of the advanced flowback system. Monitoring an apparatus may include any conventional parameters common to the field without departing from the scope of this disclosure.

An intervention workover control (IWOC) system 71 may be installed upon each OSV 67. An IWOC system 71 may provide a physical connection from the standardized monitoring, control, power, and chemical injection modules 69 to the various apparatuses within the advanced extended flowback system. Communication lines, electrical power, hydraulic power, and chemicals may be routed through separate tubings within the IWOC 71 umbilical to support the various apparatuses. For example, an umbilical tubing containing power line(s) and fluid line(s) (e.g., for flowing chemicals therethrough) may be extended from an OSV 67 to the subsea module 23 for operation and control of the subsea module 23 from the OSV 67. In other embodiments, alternate methods (not pictured) may be used to connect the standardized monitoring, control, power, and chemical injection modules 69 to the various points along the containment system.

Each of the standardized monitoring, control, power, and chemical injection modules 69 may be networked together using a radio, satellite, or other type of telecommunication system to enable the remote operation of the entire containment system from a single control room located offshore or on the shore, enabling the operation of the entire containment system by a single person or a small team. By comparison, conventional extended flowback systems, such as those based upon MCVs 5 (see FIG. 1), may require large teams to operate and function. In some situations, a MCV 5 may require around 50 personnel members to operate during an emergency blowout situation. In contrast, centralized remote operation of the subsea elements of the advanced extended flowback system removes the need for personnel to be in close proximity to the blowout location, removing personnel from exposure to potentially harmful hydrocarbon vapors. Further, centralized remote operation of the mini spar 43 removes personnel from exposure to the radiant heat from the gas flare, in contrast to current commercially implemented surface systems that are continually manned during operations.

Installation of the advanced extended flowback system may be rapidly completed by remotely operated vehicles (ROVs) and standard offshore construction vessels. In one or more embodiments, system installation may be completed in two weeks. However, there are other embodiments where installation may take longer, depending on weather, location, and other pertinent conditions relevant to the subsea well control incident. In contrast to other subsea well control response systems, use of ROVs in the advanced extended flowback system is limited to installation only. All operational control may be provided by the standardized monitoring, control, power, and chemical injection modules 69 via the IWOC systems 71, in contrast to conventional systems, which predominantly reply upon manual control of appurtenances at the sea floor via ROV.

Figure 3:
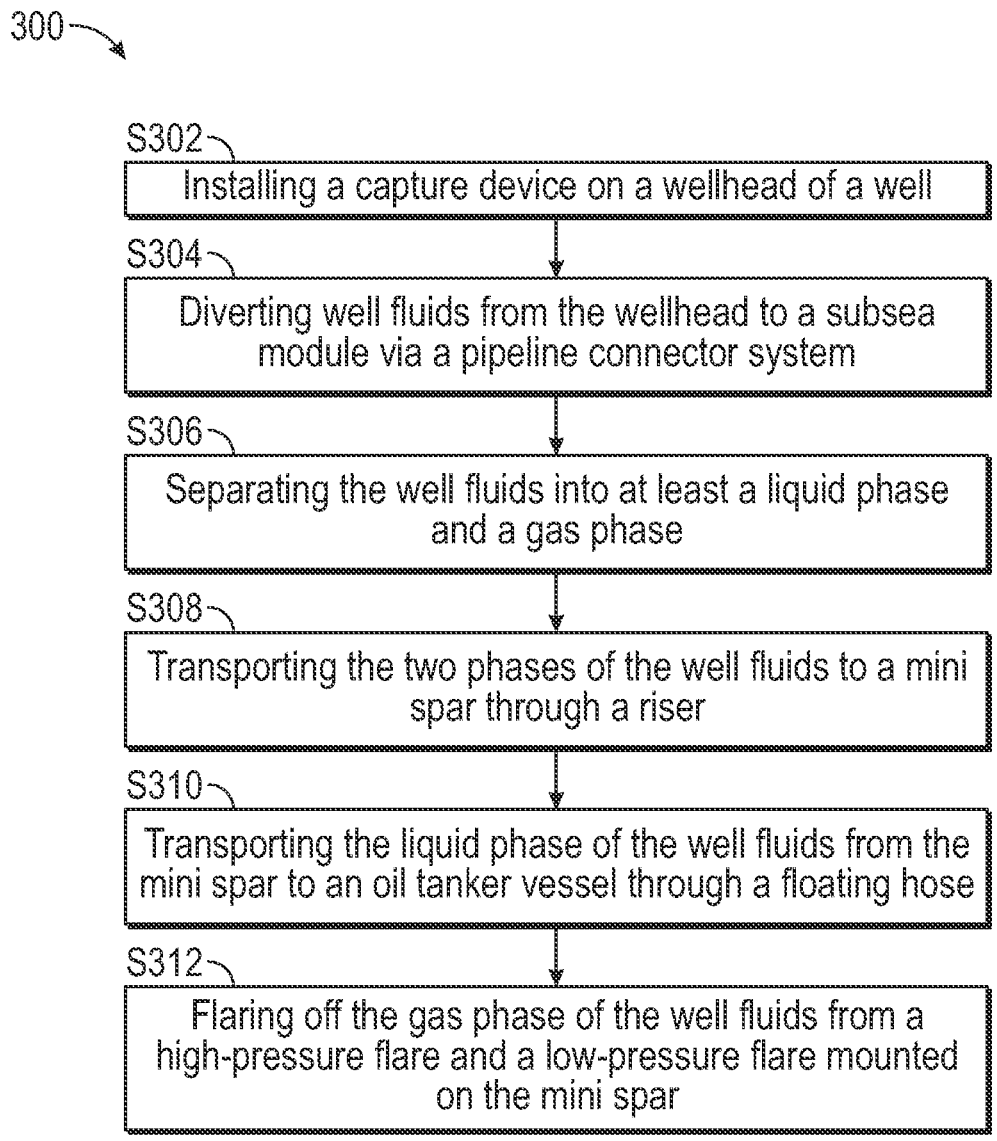
FIG. 3 shows a flowchart of a method in accordance with one or more embodiments.

Turning now to FIG. 3, FIG. 3 depicts a flowchart in accordance with one or more embodiments. More specifically, FIG. 3 depicts a flowchart 300 of a method for response to a well control incident. Further, one or more blocks in FIG. 3 may be performed by one or more components as described in FIGS. 1-2. While the various blocks in FIG. 3 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, in step S302, a capture device may be installed on a wellhead of a well experiencing a well control incident. In such an incident, well fluids may leak from the wellhead into the surrounding environment. In one or more embodiments, the capture device may be a capping stack 17. In other embodiments, particularly those where sealing of the wellhead is not possible due to damage, the capture device may be a top hat or a RITT 19.

Well fluids may be diverted from the capture device to a subsea module 23 via a pipeline connector system including a pipeline termination unit 21 and subsea flowline 25, S304. The pipeline termination unit 21 may include a manifold and may be connected to the subsea module 23 by a subsea flowline 25. Well fluids may flow through the subsea flowline 25 from the pipeline termination unit 21 to the subsea module 23.

Once the well fluids have reached the subsea module 23, they may be processed and separated in the subsea separator 29. In one or more embodiments, the well fluids may be separated into two phases: a liquid phase and a gas phase, S306. There may be other embodiments in which the liquid phase is further separated into oil and water with each liquid being transferred to the surface in a separate riser. Additionally, in some embodiments, sand may be separated from the well fluids either before reaching the subsea separator 29 or by the subsea separator 29. An electric heater 31 may be disposed within the subsea module 23 and may heat the well fluids to assist in separation. Heating the well fluids allows liberated gases to rise, leaving behind only an oil and water mixture which may be referred to as "dead oil". In some embodiments, the electric heater 31 may be disposed along the subsea flowline 25, such that heating of the well fluids occurs prior to entry into the subsea module 23. There may also be embodiments where subsea cooling systems are installed within or before the subsea module 23 to further assist in the control of the temperature of the well fluids.

In embodiments where the containment system comprises a top hat or RITT 19, a suction booster pump 35 may be used to provide adequate pressure to pump fluids through the advanced extended flowback system. A suction booster pump 35 is particularly applicable in an open loop system, such as that established when using a top hat or RITT, however the suction booster pump 35 may also be used in any situation in which the pressure of the well fluids is insufficient to flow the fluids throughout the rest of the system. The suction booster pump 35 may be located within the pipeline termination unit 21 or within the subsea module 23 such that fluids may be pressurized prior to entry into the subsea separator 29.

Following subsea processing and separation, the well fluids may be transported to a mini spar 43 through a pipe-in-pipe riser 41, S308. In one or more embodiments, the liquid phase from the well fluid may flow through the inner pipe and the gas phase from the well fluid may flow through the annular region formed between the inner and outer pipes. In other embodiments, the liquid phase may flow through the annular region and the gas phase may flow through the inner pipe. In yet other embodiments (not pictured), liquids and gases my flow up separate risers to the mini spar 43 on the ocean surface.

Once transported to the mini spar 43, the liquid phase and the gas phase from the well fluid may be further processed to ensure adequate separation. The liquid phase may pass through a high efficiency degasser 55, where any remaining gases are removed. The refined liquid phase may then be transported from the mini spar 43 to an oil storage vessel 63 through a floating hose 61, S310. The remaining gases may be flared off through a low-pressure flare 59, S312. The gas phase from the well fluid may pass through a high efficiency liquid knockout drum, where any remaining condensed liquids are removed from the gas phase. The gas phase may then be flared off from a high-pressure flare 57, S312. Any residual liquids captured in the knock-out drum may be burned using a dedicated burner also installed on the mini-spar 43 or pumped to the oil storage vessel 63 through floating hose 61. There may also be embodiments in which a flare water curtain is implemented around the mini spar 43 to enable adjacent oil storage vessels 63 to position closer to the mini spar 43.

In one or more embodiments, one or more offshore supply vessels (OSVs) 67 with standardized monitoring, control, power, and chemical injection modules 69 may be used to control the method described in flowchart 300. For example, at least one OSV 67 may be connected to each component of the flowback system, including but not limited to the containment system, the subsea module 23, and the mini spar 43. Each OSV 67 may provide power, chemicals, and a means for controlling and monitoring the apparatus through an IWOC system 71. For example, in one or more embodiments, an OSV 67 may monitor flow rates, pressures, and temperatures of well fluids within the subsea module 23. Further, in the same embodiments, flow rates, pressures, temperatures, and other parameters may be controlled according to predetermined guidelines or user input. In some embodiments, one or more OSVs 67 may provide chemicals, such as hydrate inhibitors, to various apparatuses. For example, the OSVs 67 may provide hydrate inhibitors to the containment system to prevent the build-up of gas hydrates.

Embodiments of the present disclosure may provide at least one of the following advantages. Present emergency response systems for subsea well control incidents require equipment, such as MCVs 5, to be deployed to the incident site. MCVs 5 are custom designed, build, and limited in both number and availability, as well as being extremely expensive to operate. Further, MCVs 5 require large crews of personnel in order to operate properly. In contrast, embodiments of the present disclosure implement offshore supply vessels 67 and conventional storage vessels 63, both of which are both plentiful in number and readily available. Further, the incorporation of OSVs 67 allow for complete remote control of the advanced extended flowback system, minimizing the need for ROVs in operation of the advanced extended flowback system.

The application of remote operations through the standardized monitoring, control, power and chemical injection modules 69 and OSVs 67 also require minimal personnel in comparison to MCVs 5, therefore minimizing the number of staff members required to be on site during response operations, and improving safety for personnel.

An advanced extended flowback system has the advantage of increased simplicity of both installation and operation. Installation of the system can be completed in as little as two weeks and can be facilitated by standard offshore construction vessels, with no specialized equipment required. Further, the system lends itself well to long term preservation between incident responses by minimizing the number of rotating components and streamlining maintenance requirements. The simplicity of the system may also improve the reliability of containment operations over the systems currently available. In the event that temporary site evacuation during response operations is necessary, for example during a tropical storm or hurricane, the majority of the system (all subsea components and the mini-spar) can remain installed on location during the weather event, reducing the amount of time it takes to resume operations once the OSVs 67 and oil storage vessels 63 are able to return to site.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A system for emergency response to a well control incident, comprising:

a capture device fitted to a leaking subsea wellhead;

a pipeline termination unit fluidly connected to the capture device;

a subsea module fluidly connected to the pipeline termination unit via a subsea flowline, wherein the subsea module comprises a subsea separator, and wherein the subsea module is anchored to a seabed; and a mini spar fluidly connected to the subsea module by a riser system, wherein the mini spar comprises:

a can, having an upper section and a lower section;

a swivel connected to the upper section of the can, wherein the swivel comprises:

a connection point for tethering a vessel to the mini spar;

a liquid knockout drum mounted to the swivel;

a degasser mounted to the swivel;

a first flare fluidly connected to the liquid knockout drum; and a second flare fluidly connected to the degasser.

2. The system of claim 1, wherein the riser system comprises a pipe-in-pipe riser, where a first pipe is disposed concentrically within a second pipe, such that an annular region is formed between the first pipe and the second pipe.

3. The system of claim 1, wherein the subsea module further comprises a heater and a sand flush.

4. The system of claim 1, wherein a heater is installed between the subsea flowline and the subsea module.

5. The system of claim 1, wherein the subsea module is anchored to the seabed using at least one of a mud mat and at least one suction pile.

6. The system of claim 1, wherein the capture device comprises a capping stack.

7. The system of claim 1, wherein the capture device comprises a top hat apparatus or a riser insertion tube tool.

8. The system of claim 1, wherein the subsea module further comprises a suction booster pump.

9. The system of claim 1, wherein the pipeline termination unit comprises a suction booster pump.

10. The system of claim 1, wherein one or more offshore vessels are each independently connected to one or more of the capture device, the pipeline termination unit, the subsea module, the riser system, or the mini spar.

11. A method for responding to a subsea well control incident, comprising:

installing a capture device on a wellhead or associated component of a leaking well;

diverting well fluids from the wellhead to a mini spar through a riser system, wherein the mini spar comprises:

a can, having an upper section and a lower section;

a swivel connected to the upper section of the can, wherein the swivel comprises:

a connection point for tethering a vessel to the mini spar;

a liquid knockout drum mounted to the swivel;

a degasser mounted to the swivel; and at least one flare mounted on the mini spar and fluidly connected to at least one of the liquid knockout drum and the degasser;

transporting a liquid phase separated from the well fluids from the mini spar to a storage vessel; and flaring a gas phase separated from the well fluids using the at least one flare mounted on the mini spar.

12. The method of claim 11, further comprising:

diverting the well fluids through a subsea module prior to diverting the well fluids to the mini spar;

separating the well fluids into at least two phases comprising the liquid phase and the gas phase in the subsea module; and transporting the at least two phases from the subsea module to the mini spar.

13. The method of claim 12, further comprising:

heating the well fluids in the subsea module; and flushing sand from the subsea module.

14. The method of claim 11, further comprising heating the well fluids upstream of the mini spar.

15. The method of claim 11, further comprising tethering the storage vessel to the swivel provided in the mini spar.

16. The method of claim 12, further comprising monitoring, controlling, powering, and injecting chemicals into the capture device, the subsea module, and the mini spar with at least one offshore vessel.

17. The method of claim 13, wherein sand is flushed from the subsea module using a sand flush system comprising a pump and a jetting manifold installed to the subsea module.

18. The method of claim 12, wherein the riser system comprises a pipe-in-pipe riser having a first pipe disposed concentrically within a second pipe, such that an annular region is formed between the first pipe and the second pipe.

19. The method of claim 18, further comprising transporting the liquid phase of the well fluids through an interior of the first pipe and the gas phase of the well fluids through the annular region from the subsea module to the mini spar.

20. The method of claim 18, further comprising transporting the gas phase of the well fluids through an interior of the first pipe and the liquid phase of the well fluids through the annular region from the subsea module to the mini spar.

* * * * *